United States Patent [19]

Hood et al.

[11] 4,328,630

[45] May 11, 1982

[54] PULLYOKE ASSEMBLY FOR A SCRAPER

[75] Inventors: Richard A. Hood, Stow; Dale C. Greig, Willoughby Hills; Ralph E. Nemecek, Lyndhurst, all of Ohio

[73] Assignee: General Motors Corporation, Detroit, Mich.

[21] Appl. No.: 206,616

[22] Filed: Nov. 13, 1980

[51] Int. Cl.[3] ..... E02F 3/62

[52] U.S. Cl. ..... 37/129; 280/476 R

[58] Field of Search ..... 37/124 R, 126 R, 126 A, 37/126 AA, 126 AB, 126 AD, 126 AE, 129, 8; 280/476 R

[56] References Cited

U.S. PATENT DOCUMENTS 3,314,176 4/1967 Jones ..... 37/129
3,406,470 10/1968 Fall et al. ..... 37/129
3,657,830 4/1972 Hamilton ..... 37/129
4,266,628 5/1981 Fisher et al. ..... 37/129 X

*Primary Examiner*—E. H. Eickholt
*Attorney, Agent, or Firm*—Edward J. Biskup

[57] ABSTRACT

A pullyoke assembly for a scraper that includes a transverse torque tube having a central tubular member rigidly interconnecting the lower portions of a pair of drawbar members and being connected through each of the drawbar members to an outer tubular member which has a pair of outwardly flared ends, with one of the flared ends being rigidly secured to a pull-arm that extends rearwardly for pivotal connection with a scraper bowl, and the other of the flared ends being connected to one of the drawbar members in axial alignment with the central tubular member.

3 Claims, 7 Drawing Figures

PULLYOKE ASSEMBLY FOR A SCRAPER

Figure 1:
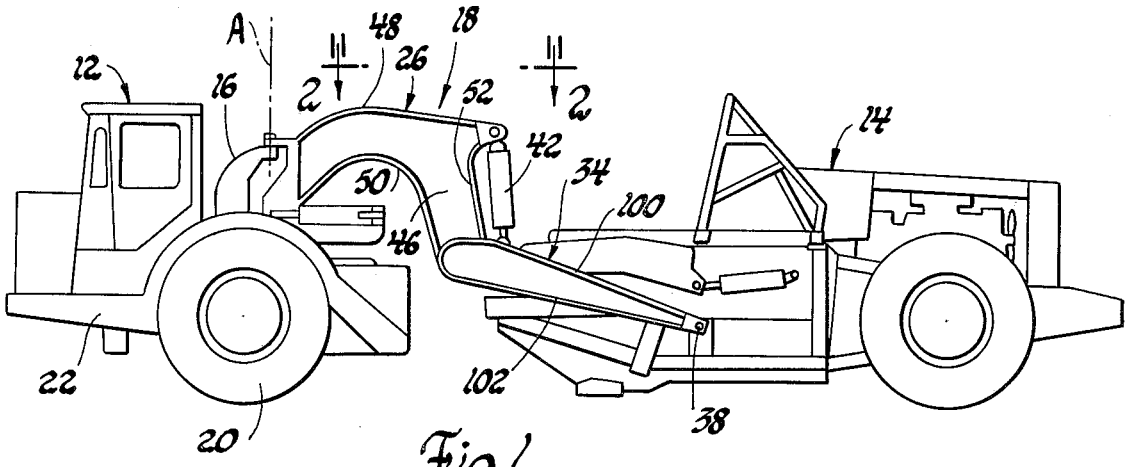

This invention concerns scrapers in general and, more particularly, relates to a pullyoke assembly which serves to connect the tractor portion of the scraper to the scraper bowl.

As is well known to those skilled in the art, the pullyoke assembly is an important part of an earth-moving scraper and serves as the structural tie between the tractor and the scraper bowl. The pullyoke assembly serves to support the bowl mechanism used when loading and ejecting the payload, and its main components are the drawbar, torque tube, and a pair of pull-arms.

In one form of a pullyoke assembly heretofore used with scrapers, a unitary torque tube extended completely across the scraper bowl and was welded at the intersections of the torque tube to the pull-arms and to the drawbar. It was found that in this type of construction the joints between the torque tube and the drawbar were subjected to relatively high stress concentrations; consequently, adaptor thin-wall castings were introduced for blending the connections between the various parts of the pullyoke to minimize the inherent stress risers which occur at the joints of a structure of this type. Design efficiency was realized by using thin-wall castings to match the thin wall of the torque tube to provide a uniform stress-flow between the torque tube and the adaptor castings. Although the adaptor castings effected a significant reduction in the degree of stress concentration, each joint of the torque tube required a considerable amount of machining time and, in addition, high quality standards for the adaptor castings were required because of the thin walled construction thereof. This resulted in a pullyoke assembly that was expensive and time-consuming to manufacture.

Accordingly, the principal object of the present invention is to provide a new and improved pullyoke assembly having the blending advantages of a casting, but being more readily manufactured without requiring the expense of a casting and the excessive time required for machining the various connecting parts of the torque tube.

The above object and others are achieved with a pullyoke assembly, one end of which is connected by a hitch to a tractor and the other end of which supports a scraper bowl for pivotal movement between a raised-carry position and a lowered-dig position. The pullyoke assembly includes a pair of rearwardly diverging drawbar members which are rigidly connected to a transverse torque tube, the opposite ends of which are provided with a pair of laterally spaced pull-arms that extend rearwardly for pivotal connection with the side walls of the scraper bowl. In the preferred form, the torque tube comprises a central tubular member rigidly interconnecting the lower portions of the pair of drawbar members, and a pair of outer tubular members each of which is made from a steel plate into a cylindrical unit having a body portion. One end of the body portion is flared outwardly and terminates with a peripheral edge which is located in a plane inclined to the longitudinal center axis of the body portion. The other end of the body portion is also flared outwardly and terminates with a peripheral edge which is located in a plane substantially perpendicular to the longitudinal center axis of the body portion. In addition, weld means are provided for connecting the peripheral edge of the aforesaid one end of the body portion to one of the drawbar members and for connecting the peripheral edge of the other end of the body portion to one of the pair of pull-arms so that both outer tubular members are axially aligned with the central tubular member, and torsional bending stresses imposed by the scraper bowl on the torque tube are distributed along the body portion of each of the outer tubular members.

Figure 2:
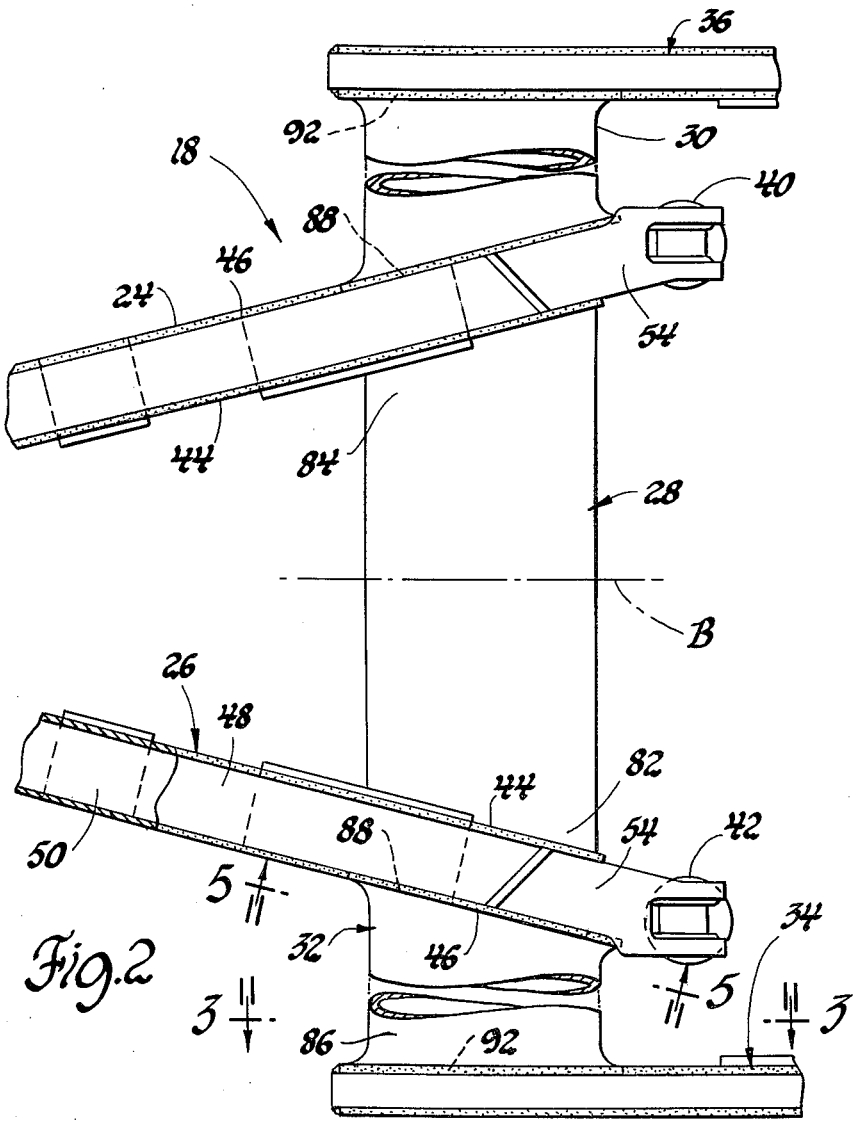
Figure 3:
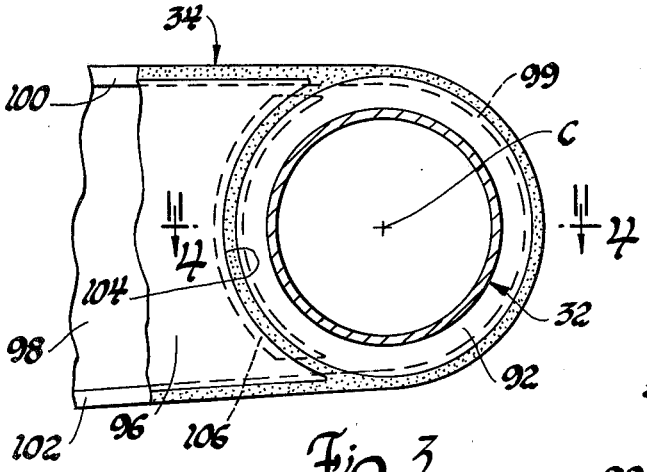
Figure 4:
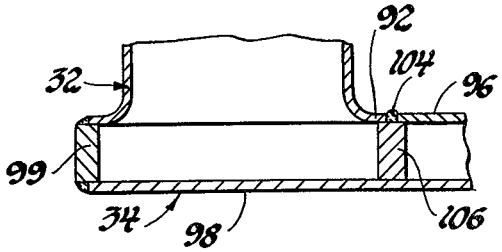
Figure 5:
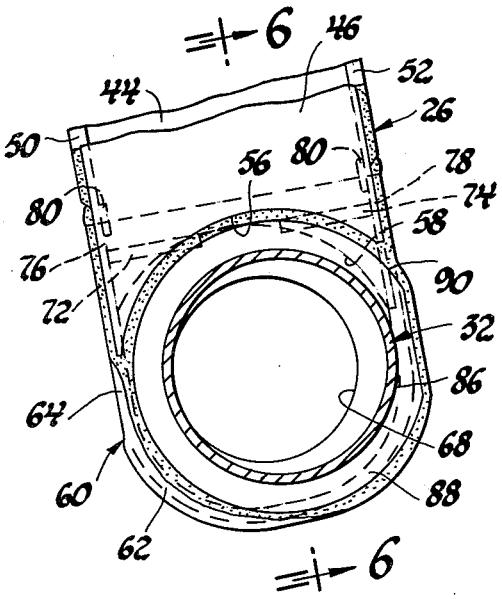
Figure 6:
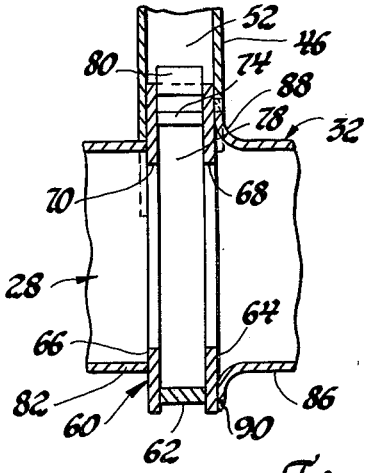
Figure 7:
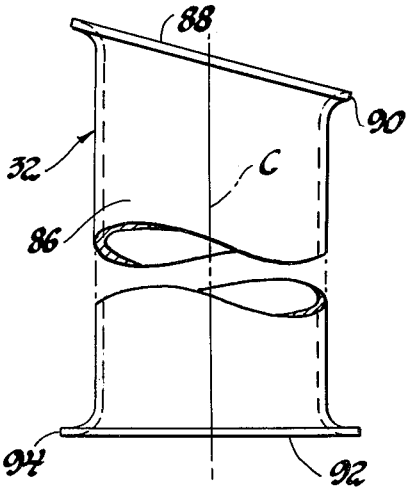

Other objects and advantages of the present invention will be apparent from the following detailed description when taken in conjunction with the accompanying drawings, in which:

- FIG. 1 is a side elevational view showing an earth-moving scraper incorporating a pullyoke assembly made in accordance with the present invention;
- FIG. 2 is an enlarged plan view of a portion of the pullyoke assembly shown in FIG. 1 and taken on line 2—2 thereof;
- FIG. 3 is a sectional view taken on line 3—3 of FIG. 2 and shows the connection between one end of the outer tubular member of the torque tube and one of the pull-arms of the pullyoke assembly;
- FIG. 4 is a sectional view taken on line 4—4 of FIG. 3;
- FIG. 5 is a sectional view taken on line 5—5 of FIG. 2 showing the connection between the other end of the outer tubular member and one of the drawbar members;
- FIG. 6 is a sectional view taken on line 6—6 of FIG. 5; and
- FIG. 7 is a plan view of one of the outer tubular members incorporated with the pullyoke assembly shown in FIG. 2.

Referring to the drawings and more particularly to FIG. 1 thereof, an off-highway earthmoving scraper is shown comprising an overhung-wheeled tractor 12 and a trailing scraper bowl 14. The tractor 12 is joined to the scraper bowl 14 through a hitch which includes an L-shaped steering frame member 16 hingedly connected to a pullyoke assembly 18, made in accordance with the invention, for relative steering articulation about a vertical steering axis "A". As is conventional with scrapers of this type, the steering frame member 16 is carried by the tractor 12 above the tractor drive wheels 20 and is connected to the tractor frame 22 by a pair of axially aligned and horizontally orientated pivot connections (not shown) which permit the tractor 12 to oscillate about a longitudinally extending horizontal axis so as to permit the scraper to traverse irregular terrain.

As seen in FIGS. 1 and 2, the pullyoke assembly 18 made in accordance with the invention includes a gooseneck formed by a pair of diverging drawbar members 24 and 26 which extend rearwardly and downwardly for rigid connection with a transverse torque tube consisting of a central tubular member 28 and a pair of outer tubular members 30 and 32. The torque tube is rigidly connected to a pair of rearwardly extending and laterally spaced pull-arms 34 and 36 each of which is connected to a side wall of the scraper bowl 14 by a spherical joint 38 for supporting the scraper bowl 14 in the usual manner for movement about a transverse horizontal axis extending through the spherical joint 38. In this regard, a pair of identical hydraulic double-acting bowl cylinders 40 and 42 extend between an upper portion of the drawbar members 24 and 26 and the forward end of the scraper bowl 14 for positioning the scraper bowl 14 between a lowered-dig position and a raised-carry position.

It will be noted that the pullyoke assembly 18, as seen in FIG. 2, is symmetrical about the longitudinal center axis "B" of the scraper bowl 14. Accordingly, a detailed description of the various parts of the drawbar member 26, the outer tubular member 32, and the pull-arm 34 only shall be provided hereinafter—it being understood that the drawbar member 24, outer tubular member 30, and pull-arm 36 have corresponding and identical parts which, if shown in the drawings, shall be identified by corresponding reference numerals.

As seen in FIGS. 2 and 5, the drawbar member 26 is essentially a fabricated weldment comprising a pair of parallel and laterally spaced side-plate members 44 and 46 which are rigidly interconnected at the upper and lower portions thereof by bar members 48, 50, and 52. The rearwardly located upper portion of the drawbar member 26 rigidly supports a pivot casting 54 which provides a pivotal connection for the upper end of the bowl cylinder 42. As seen in FIGS. 5 and 6, the lower portions of the side-plate members 44 and 46 are formed with respective curved edges 58 and 56 and define a slot-like opening in which the upper end of a torque tube connector 60 is located. The torque tube connector 60 is also made in the form of a weldment and comprises a generally U-shaped bar 62 which is rigidly secured to a pair of parallel plates 64 and 66 having axially aligned and generally circular openings 68 and 70 formed therein. A pair of aligned reinforcing bars 72 and 74 are rigidly connected to the legs 76 and 78 of the U-shaped bar 62, as well as to the pair of parallel side-plates 64 and 66. In addition, each of the legs 76 and 78 has a back-up plate 80 fixed therewith that serves as a locator during the assembly of the torque tube connector 60 into the aforementioned slot-like opening. After the torque tube connector 60 is positioned within the slot-like opening, the bar members 50 and 52 are welded to the associated back-up plate 80 while the lower portions of the side-plate members 44 and 46 are welded along the curved edges 56 and 58, as well as a long the straight vertical sides thereof, to the parallel plates 64 and 66. One end portion 82 of the central tubular member 28 is then welded to the plate 66 of the torque tube connector 60 associated with drawbar member 26; and the other end portion 84 is similarly welded to the drawbar member 24 so as to interconnect the drawbar members 24 and 26 (as shown in FIG. 2).

As seen in FIG. 7, the outer tubular member 32 has a longitudinal center axis "C" and takes the form of a cylindrical unit having a body portion 86. One end portion 88 of the body portion 86 is flared outwardly and terminates with a peripheral edge 90 which is located in a plane inclined to the longitudinal center axis "C" at an angle which allows the end portion 88 to circumferentially engage the plate 64 of the torque tube connector 60 with the longitudinal center axis "C" axially aligned with the longitudinal center axis of the central tubular member 28, as seen in FIG. 2. The other end portion 92 of the body portion 86 also is flared outwardly and terminates with a peripheral edge 94 which is located in a plane substantially perpendicular to the longitudinal center axis "C".

As seen in FIGS. 2 and 5, during assembly of the outer tubular member 32 to the torque tube connector 60 of the drawbar member 26, the outer tubular member 32 is positioned in axial alignment with the central tubular member 28—with the end portion 88 of body portion 86 in full circumferential contact with the plate 64, as hereinbefore mentioned. In this position of the outer tubular member 32, the portion of the peripheral edge 90 adjacent the curved edge 56 of the side-plate member 46 is spaced a uniform distance from the curved edge 56 (as best seen in FIG. 5). This arrangement then provides a space or gap between the curved edge 56 of the side-plate member 46 and the peripheral edge 90 of the outer tubular member 32. The entire peripheral edge 90 of the outer tubular member 32 is then welded to the outer surface of the side-plate member 46 so as to rigidly interconnect the flared end portion 88 of the body portion 86 of the outer tubular member 32 to the torque tube connector 60 in axial alignment with the central tubular member 28. Thereafter, the opposite end portion 92 of body portion 86 of the outer tubular member 32 is positioned in full circumferential contact with the pull-arm 34 and rigidly welded thereto. In this connection—and as best seen in FIGS. 2, 3, and 4, the pull-arm 34 comprises respective inner and outer plate members 96 and 98 which are secured to a U-shaped bar member 99 having elongated legs 100 and 102 which extend rearwardly for rigid connection with the casting which is part of the spherical joint 38.

As in the case with each lower portion of the side-plate members 44 and 46 of the drawbar member 26 and as seen in FIG. 3, the inner plate member 96 of the pull-arm 34, at the front end thereof, is formed with a curved edge 104 which lies on a circle having its center in axial alignment with the longitudinal center axis "C" of the outer tubular member 32. In addition, an arcuate back-up bar 106 is secured to the respective inner and outer plate members 96 and 98 adjacent the curved edge 104 of the inner plate member 96 (as seen in FIG. 3), and the curved edge 104 is welded to the back-up bar 106. Accordingly, during assembly of the outer tubular member 32 to the pull-arm 34, the flared end portion 92 of the outer tubular member 32 is positioned concentrically with respect to the curved edge 104 of the inner plate member 96 and the curved front portion of the U-shaped bar member 99, as seen in FIG. 3. The peripheral edge 94 of the outer tubular member 32 lies on a circle having a diameter less than the diameter of the circle on which the curved edge 104 lies and therefore a space is provided between the peripheral edge 94 and the curved edge 104 of the inner plate member 96. This arrangement permits the entire peripheral edge 94 of the outer tubular member 32 to be welded to the curved front portion of the U-shaped bar member 99, as well as to the back-up bar 106, as seen in FIGS. 3 and 4.

One of the advantages that is realized by fabricating a pullyoke assembly as described above is that by using flared ends at opposite ends of each of the outer tubular members 30 and 32, sharp corners are eliminated so that the welds which connect the outer tubular members 30 and 32 to the drawbar members 24 and 26 and to the pull-arms 34 and 36 are located at points spaced from the areas where substantial torsional bending stresses would normally be imposed on the torque tube when the scraper bowl 14 is loaded with material. Thus, the torsional bending stresses can be transferred through the flared end portions 88 and 92 of each of the outer tubular members 30 and 32 and to the structure of the drawbar members 24 and 26.

Another known advantage is that the central tubular member 28 and the outer tubular members 30 and 32 can each be made from a flat sheet of steel which is subsequently rolled and welded into a cylindrical member. Thereafter, the flaring at each end of the cylindrical member can be accomplished by a hot-forming process over a die. As should be apparent, the die would take the form of the finished internal configuration, be held stationary, and the heated steel cylindrical member would be "pushed" over the die until the desired configuration is obtained. A different die would be needed for each end of the cylindrical member because of the required angle—in this instance, at the flared end portion which attaches to the drawbar members 24 and 26.

Thus, in this form of a pullyoke assembly the use of castings is minimized and, instead, weldments are utilized which do not require any machining so that manufacture of the pullyoke assembly is facilitated.

Various changes and modifications can be made in this construction without departing from the spirit of the invention. Such changes and modifications are contemplated by the inventors, and they do not wish to be limited except by the scope of the appended claims.

The embodiments of the invention in which an exclusive property or privilege is claimed are defined as follows:

1. In an earthmoving scraper including a pullyoke assembly connected to a tractor and having a pair of rearwardly diverging drawbar members rigidly supporting a transverse torque tube the opposite ends of which are provided with a pair of pull-arms that extend rearwardly for pivotal connection with the side walls of a scraper bowl, the improvement wherein each of said pair of pull-arms comprises a U-shaped bar having elongated legs which extend rearwardly along one side of said scraper bowl; a back-up bar extending between said legs of said U-shaped bar; inner and outer plate members secured to said U-shaped bar and to said back-up bar; said torque tube comprising a central tubular member and a pair of outer tubular members, said central tubular member rigidly interconnecting the lower portions of said pair of drawbar members, each of said pair of outer tubular members having a longitudinal center axis and having a body portion one end of which is flared outwardly and terminates with a peripheral edge located in a plane inclined to said longitudinal center axis and the other end of which is flared outwardly and terminates with a peripheral edge located in a plane substantially perpendicular to said longitudinal center axis; and weld means connecting said peripheral edge of said one end of said body portion to one of said pair of drawbar members and connecting said peripheral edge of said other end of said body portion to said U-shaped bar and said back-up bar of said one of said pair of pull-arms whereby said pair of outer tubular members are axially aligned with said central tubular member and torsional bending stresses imposed by said scraper bowl on said torque tube are distributed along said body portion of each of said pair of outer tubular members.

2. In an earthmoving scraper including a pullyoke assembly connected to a tractor and having a pair of rearwardly diverging drawbar members rigidly supporting a transverse torque tube the opposite ends of which are provided with a pair of pull-arms that extend rearwardly for pivotal connection with the side walls of a scraper bowl, the improvement wherein each of said pair of pull-arms comprises a U-shaped bar having vertically spaced elongated legs which extend rearwardly along one side of said scraper bowl; an arcuate back-up bar extending between said legs of said U-shaped bar; inner and outer plate members secured to said U-shaped bar and to said back-up bar, said inner plate member terminating with a curved edge adjacent said back-up bar; said torque tube comprising a central tubular member and a pair of outer tubular members, said central tubular member rigidly interconnecting the lower portions of said pair of drawbar members, each of said pair of outer tubular members having a longitudinal center axis and having a body portion one end of which is flared outwardly and terminates with a peripheral edge located in a plane inclined to said longitudinal center axis and the other end of which is flared outwardly and terminates with a peripheral edge located in a plane substantially perpendicular to said longitudinal center axis; and weld means connecting said peripheral edge of said one end of said body portion to one of said pair of drawbar members and connecting said peripheral edge of said other end of said body portion to said U-shaped bar and said arcuate back-up bar of said one of said pair of pull-arms whereby said pair of outer tubular members are axially aligned with said central tubular member and torsional bending stresses imposed by said scraper bowl on said torque tube are distributed along said body portion of each of said pair of outer tubular members.

3. In an earthmoving scraper including a pullyoke assembly connected to a tractor and having a pair of rearwardly diverging drawbar members each of which has the lower portion thereof formed with a connector member for rigidly supporting a transverse torque tube, the opposite ends of said torque tube being provided with a pair of pull-arms that extend rearwardly for pivotal connection with the side walls of a scraper bowl, the improvement wherein each of said pair of pull-arms and said connector member includes a U-shaped bar having a pair of spaced legs and a pair of substantially parallel plates welded to said U-shaped bar; said torque tube comprising a central tubular member and a pair of outer tubular members, said central tubular member rigidly interconnecting said lower portions of said pair of drawbar members, each of said pair of outer tubular members having a longitudinal center axis and having a cylindrical body portion one end of which is flared outwardly and terminates with a peripheral edge located in a plane inclined to said longitudinal center axis and the other end of said body portion being flared outwardly and terminating with a peripheral edge located in a plane substantially perpendicular to said longitudinal center axis; and weld means connecting said peripheral edge of said one end of said body portion to one of said pair of parallel plates of said connector member and connecting said peripheral edge of said other end of said body portion to said U-shaped bar of said one of said pair of pull-arms whereby said pair of outer tubular members are axially aligned with said central tubular member and torsional bending stresses imposed by said scraper bowl on said torque tube are distributed along said body portion of each of said pair of outer tubular members.

* * * * *